US011391011B2

(12) United States Patent
Narikawa et al.

(10) Patent No.: US 11,391,011 B2
(45) Date of Patent: Jul. 19, 2022

(54) HYDRAULIC EXCAVATOR

(71) Applicant: HITACHI CONSTRUCTION MACHINERY CO., LTD., Tokyo (JP)

(72) Inventors: Ryu Narikawa, Tokyo (JP); Manabu Edamura, Tsuchiura (JP); Kouji Ishikawa, Tsuchiura (JP); Shiho Izumi, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 100 days.

(21) Appl. No.: 16/302,109

(22) PCT Filed: Apr. 5, 2017

(86) PCT No.: PCT/JP2017/014267
§ 371 (c)(1),
(2) Date: Nov. 16, 2018

(87) PCT Pub. No.: WO2017/203845
PCT Pub. Date: Nov. 30, 2017

(65) Prior Publication Data

US 2019/0169818 A1 Jun. 6, 2019

(30) Foreign Application Priority Data

May 26, 2016 (JP) ..... JP2016-105280

(51) Int. Cl.
*E02F 3/43* (2006.01)
*E02F 9/20* (2006.01)
*E02F 9/26* (2006.01)

(52) U.S. Cl.
CPC ..... *E02F 3/435* (2013.01); *E02F 3/43* (2013.01); *E02F 9/20* (2013.01); *E02F 9/2004* (2013.01); *E02F 9/26* (2013.01)

(58) Field of Classification Search
CPC ..... E02F 3/435; E02F 9/20; E02F 3/43; E02F 9/2004; E02F 9/26; E02F 3/437
See application file for complete search history.

(56) References Cited

U.S. PATENT DOCUMENTS 5,752,333 A * 5/1998 Nakagawa ..... E02F 3/437 37/348
5,968,104 A * 10/1999 Egawa ..... E02F 3/437 701/50

(Continued)

FOREIGN PATENT DOCUMENTS

JP 5706050 B1 4/2015
WO 2015/025986 A1 2/2015

OTHER PUBLICATIONS

International Preliminary Report on Patentability received in corresponding International Application No. PCT/JP2017/014267 dated Dec. 6, 2018.

(Continued)

*Primary Examiner* — Rami Khatib
*Assistant Examiner* — Gabriel J Lambert
(74) *Attorney, Agent, or Firm* — Mattingly & Malur, PC

(57) ABSTRACT

A hydraulic excavator includes a controller (40) that executes region limiting control to forcibly raise a boom (8) in such a manner that a position of a tip end of a bucket (10) is kept on a target excavation surface and within a region above the target excavation surface if an operation device (45*b*, 46*a*) issues an action direction to an arm (9) or the bucket. The controller determines which is selected as a control mode over a raising speed of the boom at a time of executing region limiting control, a first mode or a second mode specified by a raising speed lower than a raising speed of the first mode if the tip end of the bucket is located below (Continued)

the target excavation surface, and controls the raising speed of the boom based on a result of determination.

4 Claims, 11 Drawing Sheets

(56) References Cited

U.S. PATENT DOCUMENTS 9,834,905 B2* 12/2017 Matsuyama ..... E02F 9/2285
2005/0150142 A1* 7/2005 Matsuda ..... E02F 9/26 37/414
2006/0245896 A1* 11/2006 Alshaer ..... E02F 9/2029 414/685
2008/0097672 A1* 4/2008 Clark ..... E02F 9/2029 701/50
2009/0056961 A1* 3/2009 Gharsalli ..... E02F 3/844 172/4.5
2014/0257646 A1* 9/2014 Ishibashi ..... E02F 3/7613 701/50
2014/0290102 A1* 10/2014 O'Donnell ..... E02F 9/2012 37/403
2015/0075147 A1* 3/2015 Shang ..... E02F 9/2296 60/327
2015/0308081 A1* 10/2015 Takaura ..... E02F 9/262 701/50
2016/0040398 A1* 2/2016 Kitajima ..... E02F 3/32 701/50
2016/0145827 A1* 5/2016 Kami ..... G05B 19/416 701/50
2016/0244950 A1* 8/2016 Kami ..... G01C 15/00
2016/0305094 A1* 10/2016 Chang ..... E02F 9/264
2016/0312434 A1* 10/2016 Shintani ..... E02F 3/43
2017/0101762 A1* 4/2017 Chaston ..... E02F 3/7604
2017/0247861 A1* 8/2017 Matsuyama ..... E02F 9/262
2017/0268204 A1* 9/2017 Shimano ..... E02F 3/435
2017/0284070 A1* 10/2017 Matsuyama ..... E02F 9/20
2018/0238026 A1* 8/2018 Choi ..... E02F 9/2296
2019/0106861 A1* 4/2019 Izumi ..... E02F 9/2296
2019/0169818 A1* 6/2019 Narikawa ..... E02F 9/20

OTHER PUBLICATIONS

International Search Report of PCT/JP2017/014267 dated Jul. 11, 2017.

* cited by examiner

HYDRAULIC EXCAVATOR

TECHNICAL FIELD

The present invention relates to a work machine.

BACKGROUND ART

In a hydraulic excavator, a boom, an arm, a bucket, and the like of a work implement (hereinafter, also referred to as "front work implement") are rotatably supported, so that a tip end of the bucket traces out a circular arc locus when the bucket is moved solely. Owing to this, in a case of forming a linear finished surface by the tip end of the bucket by, for example, an arm crowding action, then an operator needs to drive the boom, the arm, and the bucket in a combined fashion so that the tip end of the bucket traces out a linear locus; thus, the operator is required to have expertise.

To address this challenge, there is a technique for applying a function to control actuators to be driven either automatically or semiautomatically by a computer (controller) (hereinafter, referred to as machine control) to control the excavation work, and moving the tip end of the bucket along a design surface (hereinafter, also referred to as "target excavation surface") during an excavation action (arm or bucket action). As the technique of this type, there is known one for automatically controlling a boom cylinder during the excavation action by operator's operation to add a boom raising action as appropriate, and limiting a tip end position of the bucket onto the design surface.

However, in a case of conducting work for laying earth on a flat or recessed geographical feature to raise a ground level (hereinafter, referred to as "filling work"), a filled upper surface after completion serves as the design surface. The tip end of the bucket is often located below the design surface during the filling work. Owing to this, when the arm crowding action is performed in a state in which the tip end of the bucket is located below the design surface (that is, within a filling range), the machine control to limit the tip end position of the bucket onto the design surface is executed, which possibly results in sudden start of the boom raising action.

To address the problem, Patent Document 1, for example, describes a work vehicle that includes: a design surface information acquiring section acquiring data about a design surface indicative of a target shape of a work object by a work implement; a cutting edge position computing section computing a position of a cutting edge of a bucket; and an action limiting section executing action limiting control by which a boom is forcibly raised in accordance with a relative position of the cutting edge of the bucket to the design surface, and the position of the cutting edge is limited to a region above the design surface, and Patent Document 1 describes that, in a state in which the cutting edge is located away from the design surface vertically below by a predetermined distance or longer, the action limiting section does not execute the action limiting control.

PRIOR ART DOCUMENT

Patent Document

Patent Document 1: JP 5706050 B1

SUMMARY OF THE INVENTION

Problem to be Solved by the Invention

According to the work vehicle described in Patent Document 1, the action limiting section does not execute the action limiting control in the state in which the cutting edge of the bucket (tip end of the bucket) is located away from the target excavation surface (design surface) vertically below by a predetermined distance or longer. Owing to this, when the action limiting control (forced boom raising action) is suddenly executed (hereinafter, such a boom action is often referred to as "sudden action") irrespectively of operator's intention in a case of changing the distance of the cutting edge to the target excavation surface from the state of being equal to or larger than the predetermined distance to a state of being smaller than the predetermined distance. As a result, the occurrence of the sudden boom raising action causes the operator who does not desire or expect the boom raising action to feel heavy discomfort. In addition, in a case of the presence of the cutting edge of the bucket near the predetermined distance, the boom raising action under the action limiting control is executed or not executed. In this way, the changeover between on and off of the control irrespective of operator's intention possibly, frequently occurs. Owing to this, there is a concern of increasing operator's discomfort.

An object of the present invention is, therefore, to provide a work machine capable of suppressing sudden occurrence of a boom raising action (occurrence of a sudden action) while a tip end of a work implement is located below a target excavation surface.

Means for Solving the Problem

While the present application includes a plurality of means for solving the problems. As an example, there is provided a multijoint work machine including: a travel structure; a swing structure swingably attached onto the travel structure; a multijoint work implement that is attached to the swing structure and that includes a boom, an arm, and a bucket; an operation device that outputs an action direction to each of the travel structure, the swing structure, the boom, the arm, and the bucket in response to an operator's operation; and a controller that executes region limiting control to forcibly raise the boom in such a manner that a position of a tip end of the work implement is kept on a target excavation surface and within a region above the target excavation surface if the operation device issues the action direction to the arm or the bucket. The controller includes a target action determination section that determines which is selected as a control mode over a raising speed of the boom at a time of executing the region limiting control, a first mode or a second mode specified by a raising speed lower than a raising speed of the first mode if the tip end of the work implement is located below the target excavation surface, and controls the raising speed of the boom during the region limiting control on the basis of a result of determination.

Effect of the Invention

According to the present invention, it is possible to suppress sudden occurrence of a boom raising action if a tip end of a work implement is located below a target excavation surface; thus, it is possible to suppress an operator from feeling discomfort.

MODES FOR CARRYING OUT THE INVENTION

Figure 1:
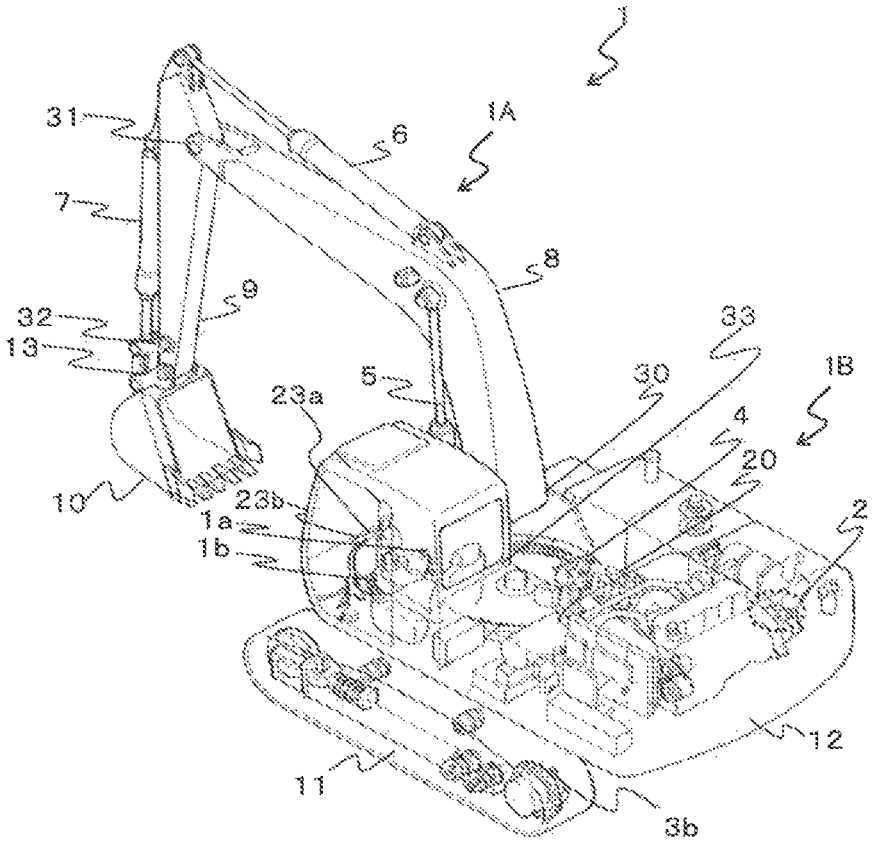
FIG. 1 is a configuration diagram of a hydraulic excavator.

Embodiments of the present invention will be described hereinafter with reference to the drawings. While an example of a hydraulic excavator provided with a bucket 10 as an attachment on a tip end of a work implement is described below, the present invention may be applied to a hydraulic excavator provided with an attachment other than the bucket. In the following description, when a plurality of same constituent elements are present, alphabets are often added to reference characters (numbers). However, the plurality of constituent elements are often denoted generically by omitting the alphabets. For example, when three pumps 300*a*, 300*b*, and 300*c* are present, these are often denoted generically by pumps 300.

First Embodiment

Figure 2:
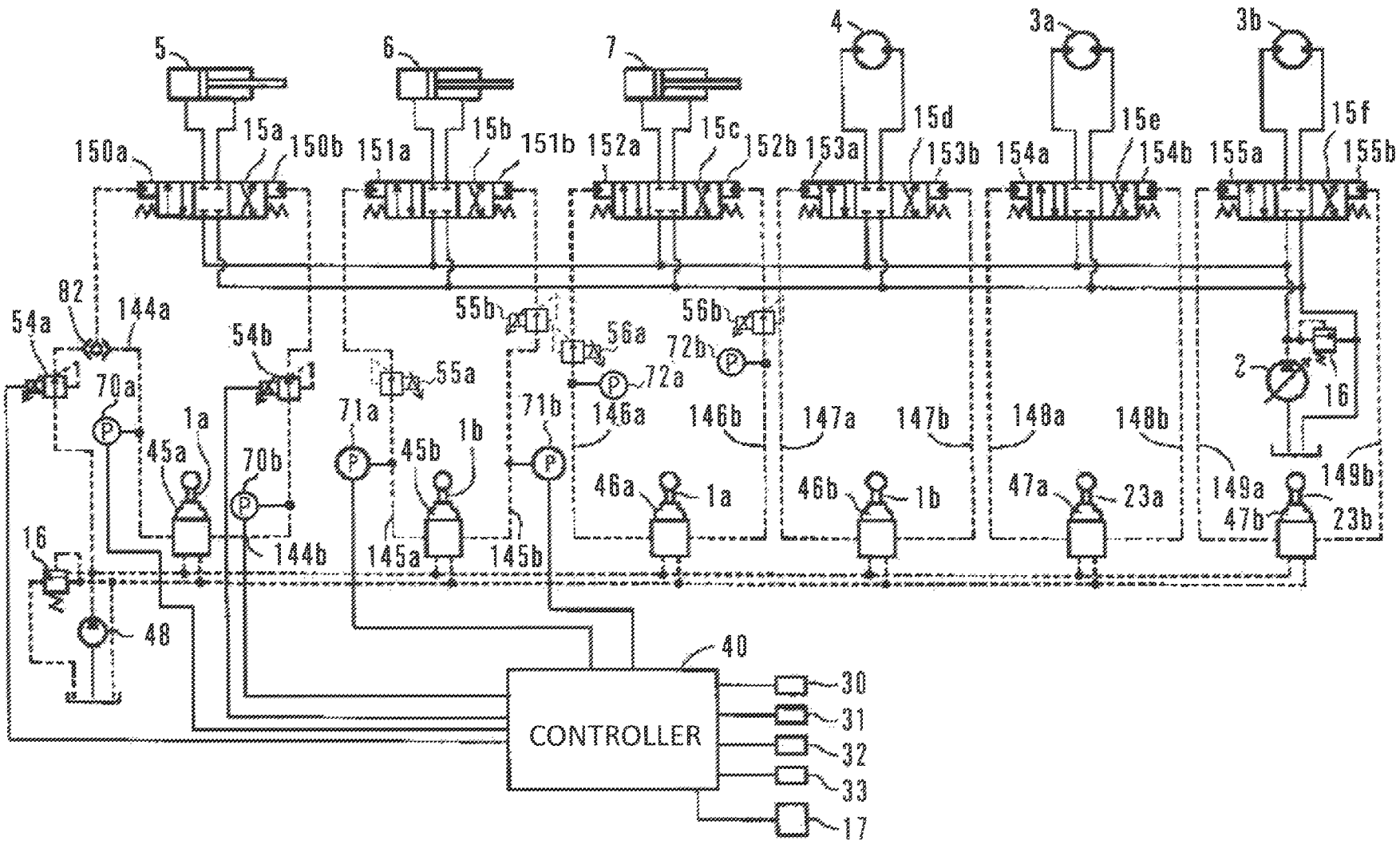
FIG. 2 is a diagram illustrating a controller together with a hydraulic drive system in the hydraulic excavator according to an embodiment of the present invention.

FIG. 1 is a configuration diagram of a hydraulic excavator according to a first embodiment of the present invention, and FIG. 2 is a diagram illustrating a controller together with a hydraulic drive system in the hydraulic excavator according to the first embodiment of the present invention. In FIG. 1, a hydraulic excavator 1 is configured with a front work implement 1A and a machine body 1B. The machine body 1B is configured with a lower travel structure 11 and an upper swing structure 12 swingably attached onto the lower travel structure 11. The front work implement 1A is configured by coupling a plurality of driven members (a boom 8, an arm 9, and a bucket 10) each rotating in a perpendicular direction, and a base end of the boom 8 of the front work implement 1A is supported by a front portion of the upper swing structure 12.

The boom 8, the arm 9, the bucket 10, the upper swing structure 12, and the lower travel structure 11 configure driven members that are driven by a boom cylinder 5, an arm cylinder 6, a bucket cylinder 7, a swing hydraulic motor 4, and left and right travel motors 3*a* and 3*b*, respectively. Action directions to these driven members 8, 9, 10, 12, and 11 are output in response to operator's operations on a travel right lever 23*a*, a travel left lever 23*b*, an operation right lever 1*a*, and an operation left lever 1*b* (which are often generically referred to as operation levers 1, 23) mounted in an operation room on the upper swing structure 12.

An operation device 47*a* (refer to FIG. 2) having the travel right lever 23*a*, an operation device 47*b* (refer to FIG. 2) having the travel left lever 23*b*, operation devices 45*a* and 46*a* having the operation right lever 1*a*, and operation devices 45*b* and 46*b* having the operation left lever 1*b* are installed in the operation room. The operation devices 45 to 47, which are hydraulic pilot operation devices, supply, as control signals, pilot pressures (often referred to as operating pressures) in response to operation amounts (for example, lever strokes) and operation directions of the operation levers 1, 23 operated by an operator to hydraulic drive sections 150*a* to 155*b* of flow control valves 15*a* to 15*f* (refer to FIG. 2) via pilot lines 144*a* to 149*b* (refer to FIG. 2) to drive these flow control valves 15*a* to 15*f*.

A hydraulic fluid delivered from a hydraulic pump 2 is supplied to the travel right hydraulic motor 3*a*, the travel left hydraulic motor 3*b*, the swing hydraulic motor 4, the boom cylinder 5, the arm cylinder 6, and the bucket cylinder 7 via the flow control valves 15*a*, 15*b*, 15*c*, 15*d*, 15*e*, and 15*f* (refer to FIG. 2) within a control valve unit 20. The boom cylinder 5, the arm cylinder 6, and the bucket cylinder 7 expand and contract by the supplied hydraulic fluid, whereby the boom 8, the arm 9, and the bucket 10 rotate and a position and a posture of the bucket 10 change. Furthermore, the swing hydraulic motor 4 rotates by the supplied hydraulic fluid, whereby the upper swing structure 12 swings with respect to the lower travel structure 11. Moreover, the travel right hydraulic motor 3*a* and the travel left hydraulic motor 3*b* rotate by the supplied hydraulic fluid, whereby the lower travel structure 11 travels.

Meanwhile, a boom angle sensor 30, an arm angle sensor 31, and a bucket angle sensor 32 are attached to a boom pin, an arm pin, and a bucket link 13 so that rotation angles $\alpha$, $\beta$, $\gamma$ (refer to FIG. 4) of the boom 8, the arm 9, and the bucket 10 can be measured, respectively, and a machine body tilt angle sensor 33 that detects a longitudinal tilt angle $\theta$ of the upper swing structure 12 (machine body 1B) with respect to a reference plane (for example, horizontal plane) is attached to the upper swing structure 12.

As illustrated in FIG. 2, the hydraulic excavator 1 of FIG. 1 has the hydraulic pump 2, a plurality of hydraulic actuators, which includes the boom cylinder 5, the arm cylinder 6, the bucket cylinder 7, the swing hydraulic motor 4, and the left and right travel motors 3*a* and 3*b* driven by the hydraulic fluid supplied from this hydraulic pump 2, the travel right lever 23*a*, the travel left lever 23*b*, the operation right lever 1*a*, and the operation left lever 1*b* provided to correspond to these hydraulic actuators 3 to 7, respectively, the plurality of flow control valves 15*a* to 15*f*, which are connected between the hydraulic pump 2 and the plurality of hydraulic actuators 3 to 7, which are controlled by the control signals output from the operation devices 45*a*, 45*b*, 46*a*, 46*b*, 47*a*, and 47*b* in response to the operation amounts and the operation directions of the operation levers 1, 23, and which control flow rates and directions of the hydraulic fluid supplied to the hydraulic actuators 4 to 7, and a relief valve 16 opened if a pressure between the hydraulic pump 2 and the flow control valves 15*a* to 15*f* is equal to or higher than a set value. These elements configure the hydraulic drive system that drives the driven members of the hydraulic excavator 1.

The hydraulic excavator of the present embodiment is provided with a control system assisting an operator's excavation operation. Specifically, the hydraulic excavator 1 is provided with an excavation control system that exercises control to forcibly raise the boom 8 (often referred to as "region limiting control") on the basis of a position relationship between the target excavation surface and the tip end of the work implement 1A such that a position of a tip end of the work implement 1A (claw tip of the bucket 10) is kept on the target excavation surface and within a region above the target excavation surface in a case of the presence of the action direction issued to the arm 9 or the bucket 10 from the operation device 45*b* or 46*a*. The excavation control system that can execute this region limiting control includes a limiting control switch 17 that is installed at a position at which the limiting control switch 17 does not obstruct an operator's view such as a position above an operation panel within the operation room and that changes over between validation and invalidation of the region limiting control, pressure sensors 70*a* and 70*b* that are provided in pilot lines 144*a* and 144*b* of the operation device 45*a* for the boom 8 and that detect a pilot pressure (control signal) as the operation amount of the operation lever 1*a*, pressure sensors 71*a* and 71*b* that are provided in pilot lines 145*a* and 145*b* of the operation device 45*b* for the arm 9 and that detect a pilot pressure (control signal) as the operation amount of the operation lever 1*b*, a solenoid proportional valve 54*a* that has a primary port side connected to a pilot pump 48 and that reduces a pilot pressure from the pilot pump 48 to output the reduced pilot pressure, a shuttle valve 82 that is connected to a secondary port side of the solenoid proportional valve 54*a* in the pilot line 144*a* of the operation device 45*a* for the boom 8, that selects a higher pressure from between the pilot pressure in the pilot line 144*a* and the control pressure output from the solenoid proportional valve 54*a*, and that guides the selected higher pressure to the hydraulic drive section 150*a* of the flow control valve 15*a*, a solenoid proportional valve 54*b* that is installed in the pilot line 144*b* of the operation device 45*a* for the boom 8 and that reduces the pilot pressure in the pilot line 144*b* in response to an electrical signal to output the reduced pilot pressure, and a controller 40 that is a computer capable of executing the region limiting control.

The pilot lines 145*a* and 145*b* for the arm 9 are provided with the pressure sensors 71*a* and 71*b* each detecting the pilot pressure and outputting the pilot pressure to the controller 40 and solenoid proportional valves 55*a* and 55*b* each reducing the pilot pressure on the basis of a control signal from the controller 40 and outputting the reduced pilot pressure. The pilot lines 146*a* and 146*b* for the bucket 10 are provided with pressure sensors 72*a* and 72*b* each detecting the pilot pressure and outputting the pilot pressure to the controller 40, and solenoid proportional valves 56*a* and 56*b* each reducing the pilot pressure on the basis of a control signal from the controller 40 and outputting the pilot pressure. It is noted that connection lines among the pressure sensors 71 and 72, the solenoid proportional valves 55 and 56, and the controller 40 are not depicted in FIG. 2 because of space limitations.

Shape information and position information about the target excavation surface stored in a ROM 93 or RAM 94 to be described later, detection signals of the angle sensor 30 to 32 and the tilt angle sensor 33, and detection signals of the pressure sensors 70 to 72 are input to the controller 40. Furthermore, the controller 40 outputs electrical signals for correcting the control signals (pilot pressures) for exercising excavation control (region limiting control) to limit a region to the solenoid proportional valves 54 to 56.

Figure 3:
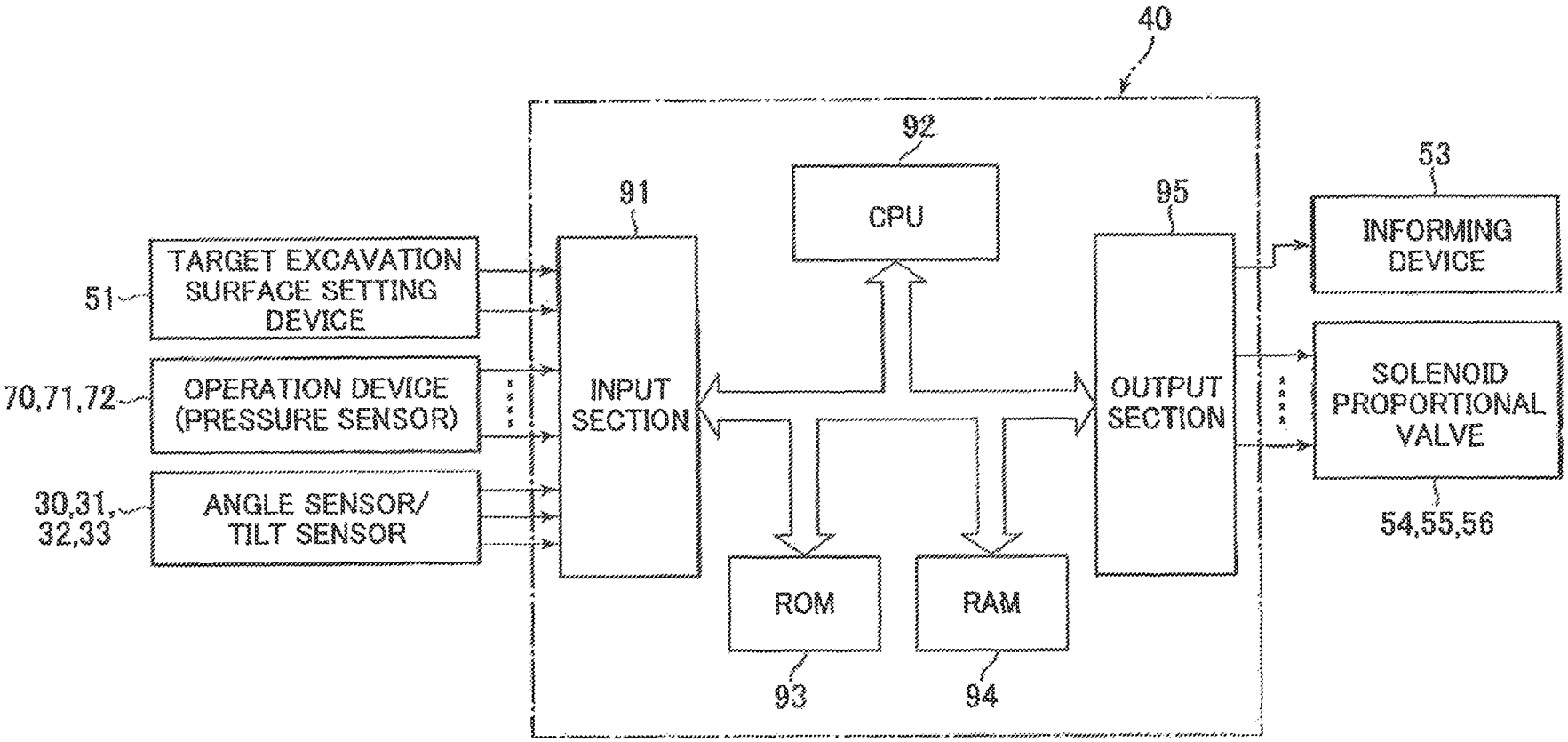
FIG. 3 is a hardware configuration diagram of the controller.

FIG. 3 illustrates a hardware configuration of the controller 40. The controller 40 has an input section 91, a central processing unit (CPU) 92 that is a processor, a read only memory (ROM) 93 and a random access memory (RAM) 94 that are storage devices, and an output section 95. The signals from the operation devices 45 to 47, a signal from a setting device 51 that sets the target excavation surface, and the signals from the angle sensors 30 to 32 and the tilt angle sensor 33 are input to the input section 91, and the input section 91 performs A/D conversion. The ROM 93 is a recording medium that records a control program for executing flowcharts of FIGS. 8 and 9 to be described later, various information necessary to execute the flowcharts, and the like, and the CPU 92 performs a predetermined computing process on the signals imported from the input section 91 and the memories 93 and 94 in accordance with the control program stored in the ROM 93. The output section 95 generates to-be-output signals in response to a computation result of the CPU 92, and outputs the signals to the solenoid proportional valves 54 to 56 and an informing device 53, thereby driving/controlling the hydraulic actuators 4 to 7 and displaying images of the machine body 1B, the bucket 10, the target excavation surface, and the like on a display screen of a monitor that is the informing device 53. While the controller 40 of FIG. 3 includes semiconductor memories that are the ROM 93 and the RAM 94 as the storage devices, another storage device can be provided as an alternative to the semiconductor memories, and the controller 40 may be provided with, for example, a magnetic storage device such as a hard disk drive.

Figure 5:
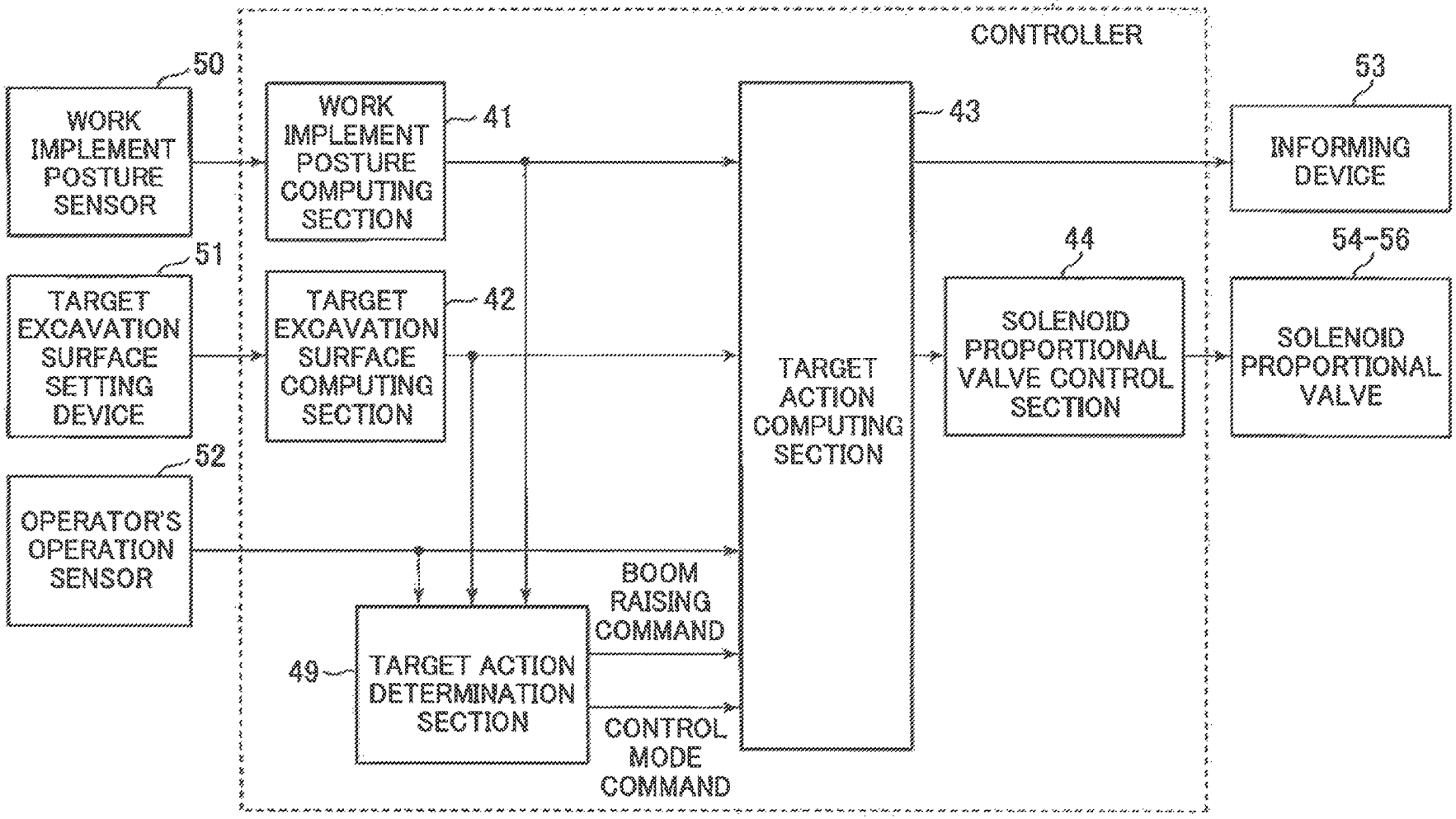
FIG. 5 is a configuration diagram of a control system according to the present invention.

FIG. 5 is a functional block diagram of the controller 40 according to the embodiment of the present invention. The controller 40 is provided with a work implement posture computing section 41, a target excavation surface computing section 42, a target action computing section 43, a solenoid proportional valve control section 44, and a target action determination section 49. In addition, a work implement posture sensor 50, a target excavation surface setting device 51, an operator's operation sensor 52, the informing device 53, and the solenoid proportional valves 54 to 56 are connected to the controller 40.

The work implement posture sensor 50 is configured with the boom angle sensor 30, the arm angle sensor 31, the bucket angle sensor 32, and the machine body tilt angle sensor 33. The target excavation surface setting device 51 is an interface to which information about the target excavation surface (including position information about the target excavation surface) can be input. The information may be input to the target excavation surface setting device 51 either by operator's manually inputting the information or by importing the information from outside via a network or the like. Furthermore, a satellite communication antenna is connected to the target excavation surface setting device 51, and the target excavation surface setting device 51 may compute excavator global coordinates. The operator's operation sensor 52 is configured with the pressure sensors 70*a*, 70*b*, 71*a*, 71*b*, 72*a*, and 72*b* that acquire the operating pressures generated by operator's operating the operation levers 1. The informing device 53 is configured with at least one of a display (display device) that displays the position relationship between the target excavation surface and the work implement 1A for the operator and a loudspeaker that informs the operator of the position relationship between the target excavation surface and the work implement 1A by a sound (including a voice). The solenoid proportional valves 54 to 56 are provided in the pilot pressure (operating pressure) hydraulic lines described with reference to FIG. 2 and can increase/decrease downstream the operating pressures generated by operator's lever operation. Alternatively, the operating pressures can be generated without the operator's lever operation.

Figure 6:
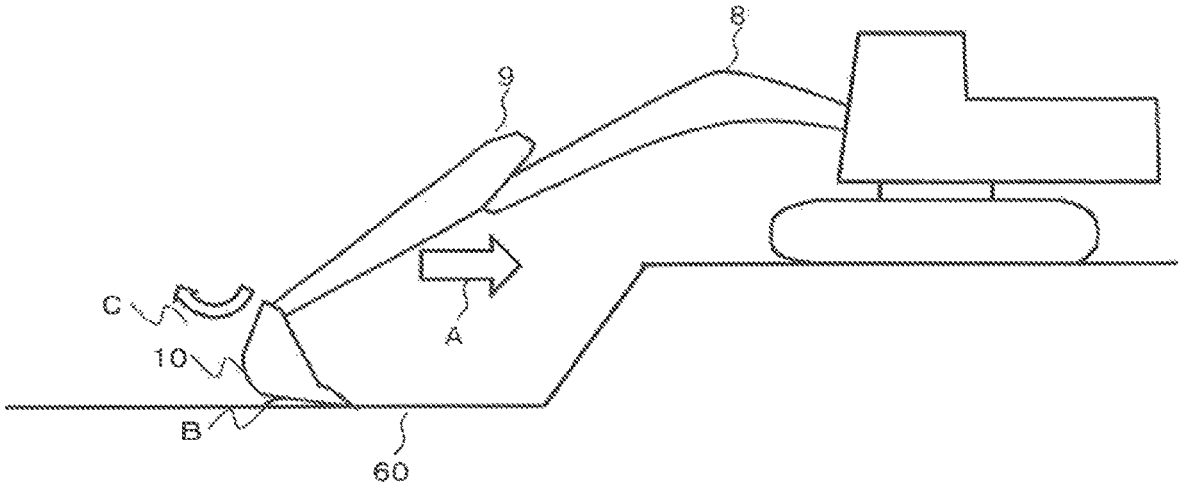
FIG. 6 is a conceptual diagram of excavation work.

FIG. 6 illustrates an example of a horizontal excavation action under machine control that is a function to control the work implement 1A either automatically or semiautomatically and to shape the target excavation surface. In a case of conducting horizontal excavation by operator's operating the operation levers 1 and an action of crowding the arm 9 in an arrow A direction, a boom raising command is output as appropriate so that the tip end (claw tip) of the bucket 10 does not penetrate a region below the target excavation surface 60, and the solenoid proportional valve 54*a* is controlled such that an action of raising the boom 8 is automatically carried out. In addition, the solenoid proportional valves 55 are controlled to carry out the action of crowding the arm 9 so as to realize an excavation speed or excavation accuracy demanded by the operator. At this time, a speed of the arm 9 may be reduced by the solenoid proportional valves 55 as needed for improvement of the excavation accuracy. Furthermore, the solenoid proportional valves 56 may be controlled to cause the bucket 10 to automatically rotate in an arrow C direction (dumping direction) so that an angle B of a back surface of the bucket 10 with respect to the target excavation surface 60 becomes a constant value and leveling work can be easily conducted. In this way, the function to control the actuators either automatically or semiautomatically with respect to the operation amounts of the operation levers 1 by the operator, and to actuate the constituent elements of the work implement such as the boom 8, the arm 9, the bucket 10, and the upper swing structure 12 is referred to as "machine control." The region limiting control is one type of machine control.

Figure 4:
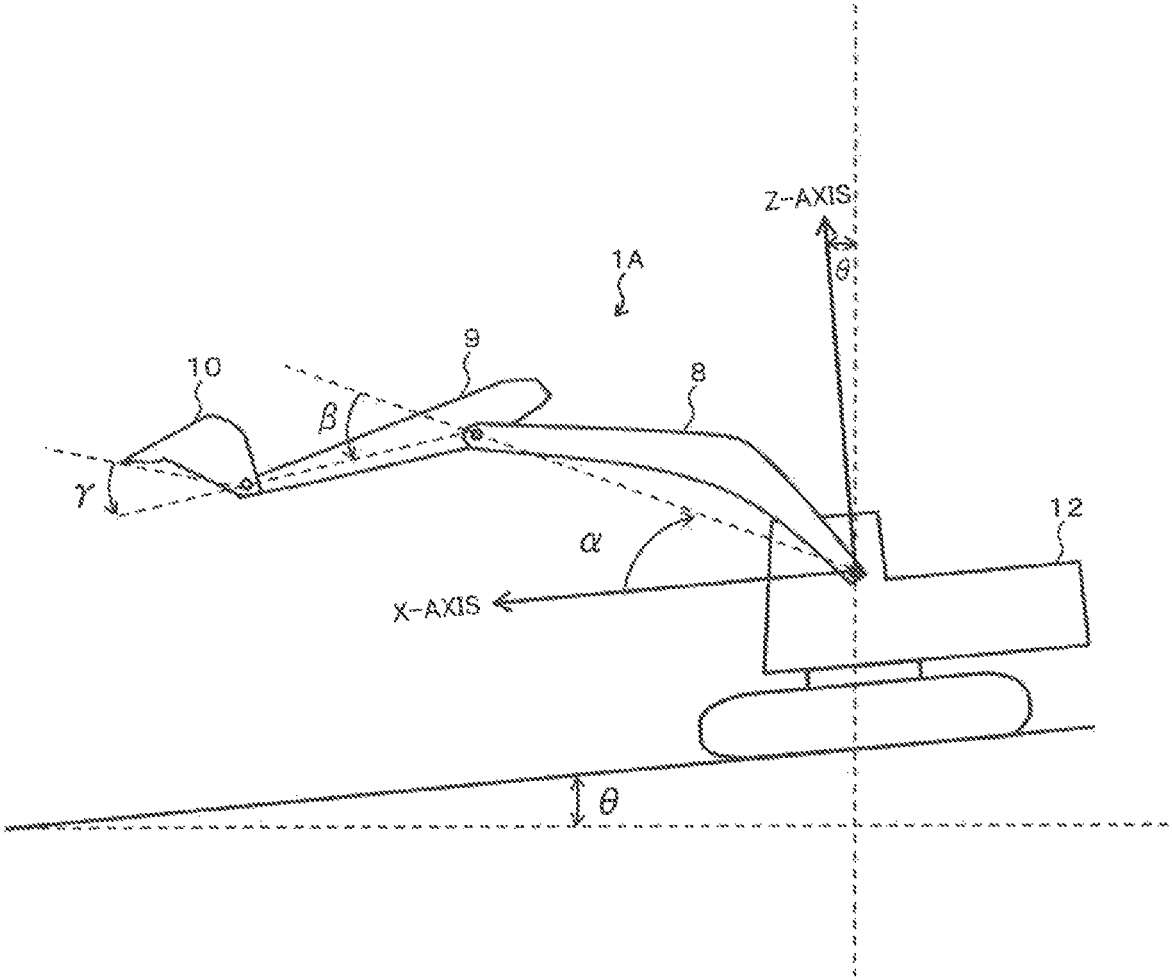
FIG. 4 is a diagram illustrating a coordinate system in the hydraulic excavator.

The work implement posture computing section 41 computes a posture of the work implement 1A on the basis of information from the work implement posture sensor 50. The posture of the work implement 1A can be defined on the basis of excavator reference coordinates of FIG. 4. The excavator reference coordinates of FIG. 4 are coordinates set to the upper swing structure 12, a base of the boom 8 rotatably supported by the upper swing structure 12 is assumed as an origin, and Z-axis is set in a vertical direction of the upper swing structure 12 and an X-axis is set in a horizontal direction thereof. It is assumed that a tilt angle of the boom 8 with respect to the X-axis is a boom angle $\alpha$, a tilt angle of the arm 9 with respect to the boom is an arm angle $\beta$, and a tilt angle of the claw tip of the bucket with respect to the arm is a bucket angle $\gamma$. It is also assumed that a tilt angle of the machine body 1B (upper swing structure 12) with respect to the horizontal plane (reference plane) is a tilt angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the tilt angle $\theta$ is detected by the machine body tilt angle sensor 33. The boom angle $\alpha$ becomes maximum when the boom 8 is raised to a maximum level (highest level) (when the boom cylinder 5 is at a stroke end in a raising direction, that is, when a boom cylinder length is the largest), and becomes minimum when the boom 8 is lowered to a minimum level (lowest level) (when the boom cylinder 5 is at a stroke end in a lowering direction, that is, when the boom cylinder length is the smallest). The arm angle $\beta$ becomes minimum when an arm cylinder length is the smallest, and becomes maximum when the arm cylinder length is the largest. The bucket angle $\gamma$ becomes minimum when a bucket cylinder length is the smallest (as depicted in FIG. 4), and becomes maximum when the bucket cylinder length is the largest.

The target excavation surface computing section 42 computes the target excavation surface 60 on the basis of information from the target excavation surface setting device 51. The target action computing section 43 computes a target action of the work implement 1A so that the bucket 10 moves on the target excavation surface and within the region above the target excavation surface, on the basis of information from the work implement posture computing section 41, the target excavation surface computing section 42, the target action determination section 49, and the operator's operation sensor 52. The solenoid proportional valve control section 44 computes commands to the solenoid proportional valves 54 to 56 on the basis of commands from the target action computing section 43. The solenoid proportional valves 54 to 56 are controlled on the basis of the commands from the solenoid proportional valve control section 44. Furthermore, the informing device 53 informs the operator of various information related to the machine control on the basis of information from the target action computing section 43.

The commands output from the target action computing section 43 to the solenoid proportional valve control section 44 include a boom raising command. The boom raising command is a command output to the solenoid proportional valve control section 44 at a time of forcibly raising the boom 8 so that the position of the tip end of the bucket 10 is kept on the target excavation surface 60 and within the region above the target excavation surface 60 at a time of executing the region limiting control. When the boom raising command is input to the solenoid proportional valve control section 44, then the solenoid proportional valve control section 44 outputs a valve opening command (command current) to the solenoid proportional valve 54*a*, and a hydraulic fluid (hereinafter, referred to as secondary pressure) generated in the solenoid proportional valve 54*a* is supplied to the hydraulic drive section 150*a* to drive the control valve 15*a*. The hydraulic operating fluid is thereby guided into a bottom-side hydraulic chamber of the boom cylinder 5 from the hydraulic pump 2 to raise the boom 8. A raising speed of the boom 8 (boom raising speed) at that time is controllable by a value of a secondary pressure of the solenoid proportional valve 54*a*, that is, a command from the solenoid proportional valve control section 44 to the solenoid proportional valve 54*a*.

The target action determination section 49 determines which is more preferably selected, a first mode (normal boom raising control) or a second mode (deceleration boom raising slow action control) as a control mode over the raising speed of the boom 8 during execution of the region limiting control if the tip end of the work implement 1A is located below the target excavation surface, and outputs a result of determination to the target action computing section 43. The target action computing section 43 outputs a command computed on the basis of this result of the determination to the solenoid proportional valve control section 44. The solenoid proportional valve control section 44 outputs the command to the solenoid proportional valve 54*a* on the basis of this command, and the boom raising speed is finally controlled in the control mode selected by the target action determination section 49.

In the present embodiment, the target action determination section 49 makes the determination on the basis of a downward penetration amount of the tip end of the work implement 1A (claw tip of the bucket 10) into the target excavation surface 60, selects the second mode (deceleration boom raising slow action control) if the penetration amount is equal to or higher than a predetermined value, and selects the first mode (normal boom raising control) if the penetration amount is lower than the predetermined value. Details of the target action determination section 49 will be described with reference to FIG. 7.

Figure 7:
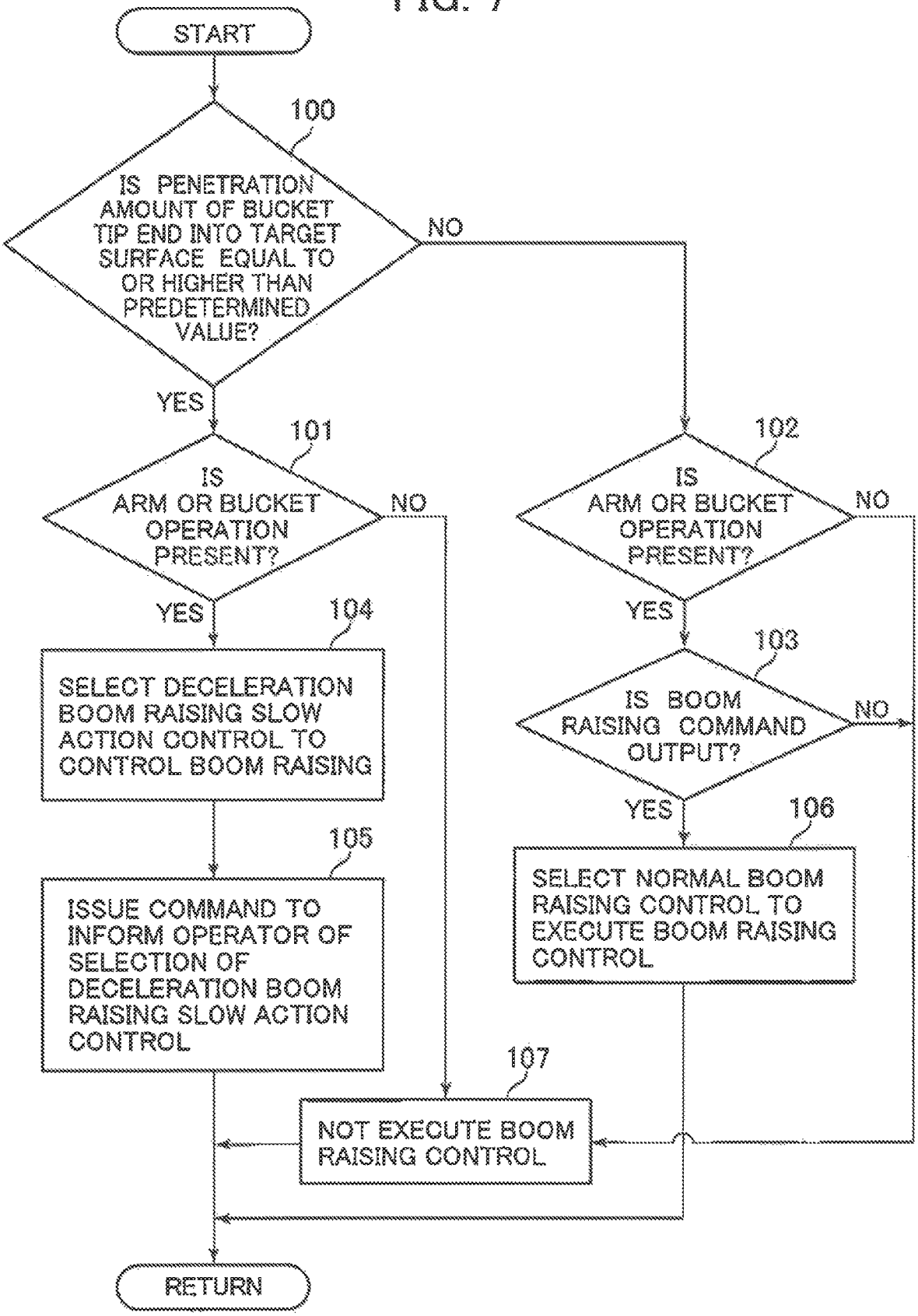
FIG. 7 is a control flowchart according to a first embodiment of the present invention.

FIG. 7 illustrates a control flowchart by the target action determination section 49 of the present embodiment. First, in Step 100, the target action determination section 49 computes the distance between the target excavation surface 60 and the tip end of the bucket 10 on the basis of the position of the tip end of the bucket 10 in the excavator reference coordinates input from the work implement posture computing section 41 and the position of the target excavation surface (abbreviated as "target surface" in FIG. 7) 60 in the excavator reference coordinates input from the target excavation surface computing section 42. In addition, it is assumed that the distance is a penetration amount D of the work implement 1A into the target excavation surface 60 and the penetration amount D of the work implement 1A is the penetration amount D of the tip end of the bucket 10 in a case in which the tip end of the bucket 10 is located below the target excavation surface 60. If the penetration amount D is equal to or higher than a predetermined value D1 (for example, 300 mm), a process goes to Step 101.

In Step 101, the target action determination section 49 determines whether the operator causes the operation device 45*b* or 46*b* to issue the action direction to the arm 9 or the bucket 10, that is, whether the operation input is performed on the operation lever 1*b* or 1*a* on the basis of an output from the operator's operation sensor 52. If determining in Step 101 that the operation input is performed on the arm 9 or the bucket 10, the target action determination section 49 selects the deceleration boom raising slow action control as the control mode in Step 104. The target action determination section 49 thereby outputs a control mode command in the second mode to the target action computing section 43, and the boom raising speed during the boom raising control is controlled in the second mode by the solenoid proportional valve 54*a*.

Now, the normal boom raising control (first mode) and the deceleration boom raising slow action control (second mode) will be described. Normally, when the region limiting control described above is executed, then the boom raising command is output from the target action computing section 43, and the boom raising action is controlled in such a manner that the tip end of the bucket does not penetrate the target excavation surface 60 on the basis of the command. It is assumed that the control mode over the boom raising speed at this time is the normal boom raising control (first mode). On the other hand, the deceleration boom raising slow action control (second mode) is a control mode that is not intended to prevent the penetration of the tip end of the bucket into the target excavation surface 60 but that is selected to mitigate operator's discomfort, and the boom raising speed at that time is always set lower than the speed during the normal boom raising control in the same condition. For example, the speed in the second mode can be set to a value obtained by multiplying the speed in the first mode by a predetermined rate (for example, 20%). The speed in the second mode can be kept to a predetermined value in such a manner that the speed in the second mode is always controlled to be equal to or lower than the speed in the first mode. As the predetermined value in this case, a minimum value of the boom raising speed, that is, the boom raising speed while a minimum pilot pressure that enables the control valve 15*a* to move from a neutral position is acting on the hydraulic drive section 150*a* can be selected.

The boom speed control based on the deceleration boom raising slow action control can be exercised continuously until the bucket tip end is located above the target excavation surface 60. In other words, in this case, once the deceleration boom raising slow action control is selected, the deceleration boom raising slow action control is continuously selected while the bucket tip end is penetrating into the target excavation surface 60 even if the penetration amount of the bucket tip end into the target excavation surface 60 becomes lower than the predetermined value. It is noted that this is also applicable to other embodiments.

Furthermore, if the deceleration boom raising slow action control is selected in Step 104, the target action determination section 49 issues a command to the informing device 53 to inform the operator of the selection of the deceleration boom raising slow action control in Step 105. At this time, operator's changing over the limiting control switch 17 to a region limiting control invalid position stops the selection of the deceleration boom raising slow action control and the execution of the region limiting control.

On the other hand, if determining in Step 101 that the operation input is not performed on the arm 9 or the bucket 10, the target action determination section 49 does not execute the boom raising control (Step 107).

Moreover, if determining in Step 100 that the penetration amount of the bucket tip end into the target excavation surface is equal to or lower than the predetermined value, the process goes to Step 102. In and after Step 102, the target action determination section 49 executes the normal region limiting control. First, if the target action determination section 49 determines that the arm 9 or the bucket 10 is operated on the basis of an output from the operator's operation sensor 52 in Step 102, the process goes to Step 103.

In Step 103, the target action determination section 49 determines whether the boom raising command is issued from the target action computing section 43 on the basis of an input signal from the target action computing section 43. If determining in Step 103 that the boom raising command is issued, the target action determination section 49 selects the normal boom raising control to execute boom raising in Step 106. In other words, the target action determination section 49 issues a control mode command in the first mode to the target action computing section 43, and the boom raising speed during the boom raising control is controlled in the first mode by the solenoid proportional valve 54*a*.

If determining in Step 103 that the boom raising command is not output, or determining in Step 102 that the operation input is not performed on the arm 9 or the bucket 10, the target action determination section 49 does not execute the boom raising control.

After the process goes up to "RETURN" in the flowchart, the process returns to Step 100 and the target action determination section 49 repeats the process described above.

Figure 8:
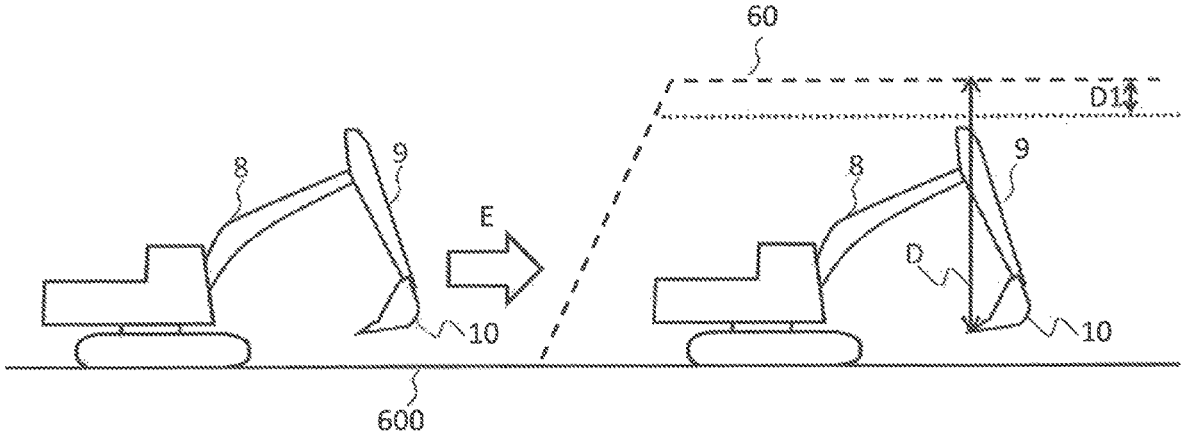
FIG. 8 is a diagram illustrating a relationship between the hydraulic excavator and a target excavation surface.

Effects by the present configuration will be described with reference to FIG. 8. FIG. 8 illustrates a position relationship between the hydraulic excavator and the target excavation surface 60. The hydraulic excavator can travel on a ground 600 in a current geographical feature. The target excavation surface 60 is indicated by a broken line and this indicates a surface that is now subjected to the filling work and to be finally shaped.

As indicated by an arrow E, it is assumed herein that the hydraulic excavator travels on the ground 600 from left to right and that the tip end of the bucket 10 penetrates into a region below the target excavation surface 60. The hydraulic excavator normally travels without operating the front work implement 1A (front operation). In other words, the boom raising control is not executed by presence of Step 101 or 102 of FIG. 7 because of no operation on the arm 9 or the bucket 10, and the tip end of the bucket 10 penetrates into the region below the target excavation surface 60 as the hydraulic excavator travels. A reference character D denotes the distance between the target excavation surface 60 and the tip end of the bucket 10 (penetration amount), and reference character D1 denotes the predetermined value in Step 100.

As disclosed in Japanese Patent No. 5706050, in a case of configuring the hydraulic excavator in such a manner that the region limiting control is not executed when the penetration amount D is equal to or higher than the predetermined value (which is assumed as D1 similarly to the present embodiment), the boom raising control is not executed while the work is conducted in a range in which the penetration amount D is equal to or higher than D1 even with the operator's operating the arm 9 in a state of the hydraulic excavator on a right side of FIG. 8. Owing to this, a probability increases that the operator forgets the execution of the region limiting control when the penetration amount D is lower than D1 or falsely understand that the region limiting control does not work at all irrespectively of the penetration amount D. In addition, if the filling work then proceeds to reduce the penetration amount D and the tip end of the bucket 10 reaches D1, the boom raising control is suddenly executed at the normal speed specified in the first mode. The occurrence of this sudden action causes the operator who does not expect or desire the boom raising action to feel heavy discomfort. Furthermore, in the work in circumstances where the penetration amount D continues to be a value near D1, the changeover between on and off of the boom raising control frequently occurs in response to a change in the penetration amount D; thus, there is a concern that the operator desired action cannot be smoothly carried out to disturb the progress of the work.

In the present embodiment configured as described above, by contrast, when the arm 9 is operated in the state of the hydraulic excavator on the right side of FIG. 8, the boom raising control is executed at the low speed specified in the second mode. The boom raising speed at this time is lower than the normal speed (that is, lower than that when the penetration amount D is lower than D1); thus, it is possible to suppress anxiety of the operator about the sudden boom raising action by the machine control. Furthermore, the forgetting or misunderstanding described above does not occur since the operator can perceive that the region limiting control functions by expression of the boom raising action. Moreover, the operator spontaneously suspends the region limiting control by the region limiting control switch 17 on an occasion of a case in which the region limiting control is unnecessary; thus, it is possible to prevent the execution of the operator unintended machine control. Therefore, according to the present embodiment, if the tip end of the work implement is located below the target excavation surface, it is possible to suppress the sudden occurrence of the boom raising action and, therefore, possible to suppress the operator from feeling discomfort.

Moreover, in the embodiment described above, if the second mode is selected, the controller 40 is configured to inform the operator of the selection through the informing device. This can further accelerate the operator's recognition of the region limiting control, so that it is possible to further suppress the occurrence of the forgetting or misunderstanding described above.

Furthermore, as mentioned above, in a case of configuring the controller 40 in such a manner that the boom speed control based on the deceleration boom raising slow action control (second mode) is continuously carried out until the tip end of the bucket is located above the target excavation surface 60, the boom raising control based on the deceleration boom raising slow action control is carried out while the bucket tip end is penetrating into the target excavation surface 60 even if the penetration amount D of the bucket tip end into the target excavation surface 60 is lower than the predetermined value D1. Owing to this, the speed of automatic boom raising does not suddenly change until the bucket tip end reaches the target excavation surface 60; thus, it is possible to mitigate operator's discomfort.

Second Embodiment

A second embodiment of the present invention will next be described. It is noted that a hardware configuration of a hydraulic excavator in the present embodiment is the same as that in the first embodiment and, therefore, not described and that functions overlapping those in the first embodiment are not sometimes described.

In the present embodiment, "determination" by the target action determination section 49 differs from that in the first embodiment, and the target action determination section 49 is configured to change the control mode over the boom raising speed during the boom raising control in the light of a reason for penetration into the target excavation surface. In other words, the target action determination section 49 changes the control mode over the boom raising speed, depending on the reason for the penetration into the target excavation surface such as the penetration due to travel or swing, the penetration due to a forward posture of the excavator, and the penetration due to other unexpected reasons (for example, the penetration due to deteriorated control accuracy during excavation).

Specifically, the target action determination section 49 determines which is preferably selected to control the boom speed during the boom raising control, the first mode or the second mode, on the basis of the action direction to the lower travel structure 11 or the upper swing structure 12 from the operation devices 46*b*, 47*a*, and 47*b* (operation levers 1*b*, 23*a*, and 23*b*) and the position relationship between the target excavation surface 60 and the tip end of the work implement 1A. In addition, the target action determination section 49 selects the second mode (deceleration boom raising slow action control) if the tip end of the work implement 1A moves below the target excavation surface 60 by the action direction to the lower travel structure 11 or the upper swing structure 12 from the operation devices 46*b*, 47*a*, and 47*b* (operation levers 1*b*, 23*a*, and 23*b*), and selects the first mode (normal boom raising control) if the action direction to the lower travel structure 11 or the upper swing structure 12 from the operation devices 47*a* and 47*b* or the operation device 46*b* is not present and if the tip end of the work implement 1A is located above the target excavation surface 60. Details of the target action determination section 49 will be described with reference to FIG. 9.

Figure 9:
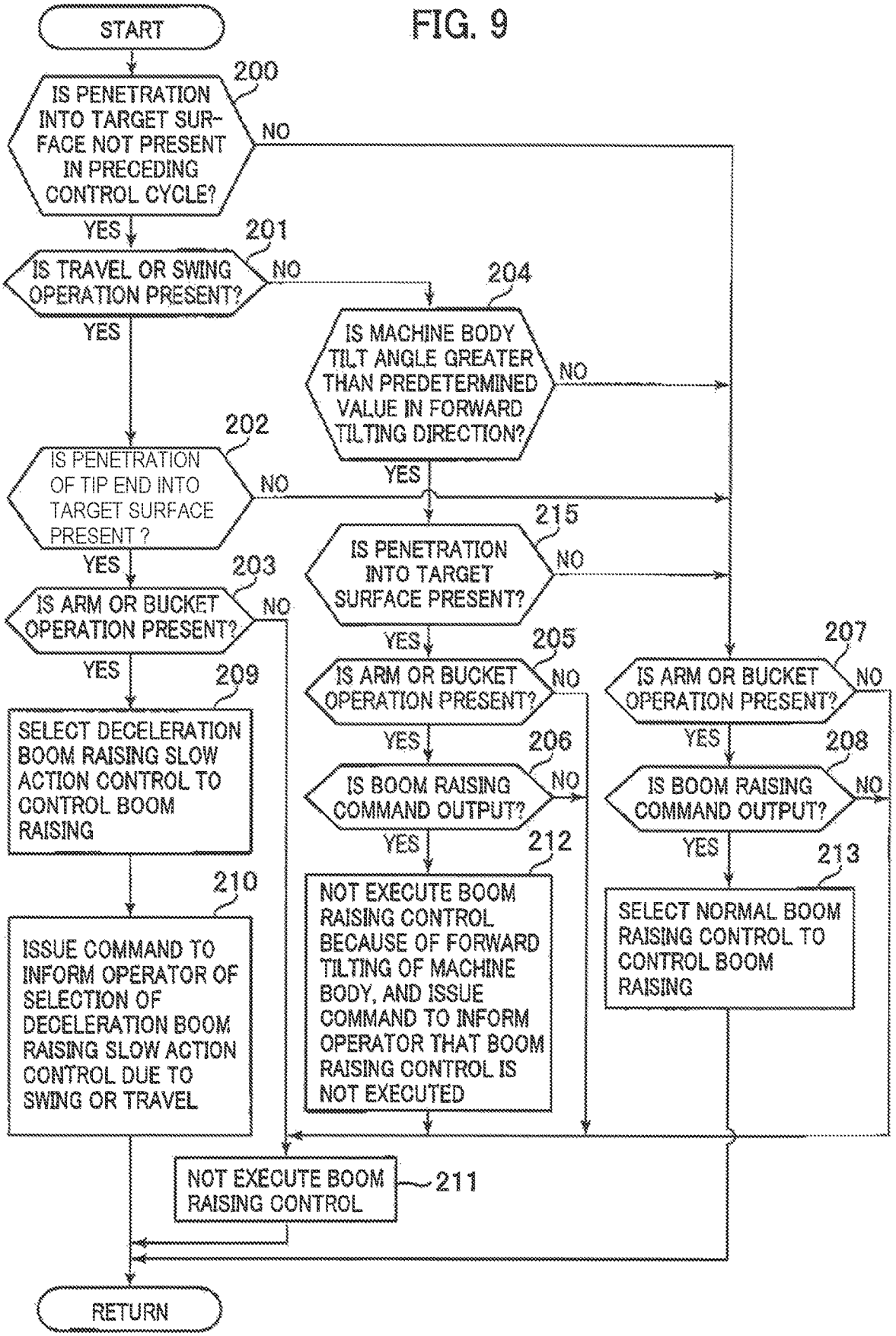
FIG. 9 is a control flowchart according to a second embodiment of the present invention.

FIG. 9 is a control flowchart by the target action determination section 49 in the present embodiment. It is noted that the present flowchart is carried out per control cycle.

First, in Step 200, the target action determination section 49 determines whether the penetration of the bucket tip end into the target excavation surface 60 was present in a control cycle just before a current control cycle. If determining that the penetration of the bucket tip end into the target excavation surface 60 was not present, the target action determination section 49 regards the current bucket tip end as being located above the target excavation surface 60 and a process goes to Step 201.

In Step 201, the target action determination section 49 determines whether a travel operation or a swing operation is present via the operation levers 23*a* and 23*b* or the operation lever 1*b*. If the target action determination section 49 determines herein that the travel operation or the swing operation is present, the process goes to Step 202.

In Step 202, the target action determination section 49 determines whether the penetration of the bucket tip end into the target excavation surface 60 is present on the basis of the position of the tip end of the bucket 10 input from the work implement posture computing section 41 and the position of the target excavation surface 60 input from the target excavation surface computing section 42. If determining in Step 202 that the penetration into the target excavation surface 60 is present, then the target action determination section 49 determines that a cause for the penetration is the travel or swing operation, and the process goes to Step 203.

In Step 203, the target action determination section 49 determines whether an operation input is performed on the arm 9 or the bucket 10 from the operation lever 1*b* or 1*a*. If determining herein that the operation input is performed on the arm 9 or the bucket 10, the target action determination section 49 selects the deceleration boom raising slow action control (second mode) as the control mode over the boom raising speed in Step 209. In addition, in Step 210, the target action determination section 49 issues a command to the informing device 53 to inform the operator of the selection of the deceleration boom raising slow action control due to the presence of the swing or travel. It is noted that the deceleration boom raising slow action control may be executed until the work implement 1A is located above the target excavation surface 60 similarly to the first embodiment.

If the target action determination section 49 determines in Step 201 that the travel operation or the swing operation is not present, the process goes to Step 204.

In Step 204, the target action determination section 49 determines whether the machine body tilt angle θ is greater than a predetermined angle θ1 in a forward tilting direction, on the basis of an output from the machine body tilt angle sensor 33. If the target action determination section 49 determines in Step 204 that the machine body tilt angle θ is greater than the predetermined angle θ1, the process goes to Step 215.

In Step 215, the target action determination section 49 determines whether the penetration of the bucket tip end into the target excavation surface 60 is present on the basis of the position of the tip end of the bucket 10 input from the work implement posture computing section 41 and the position of the target excavation surface 60 input from the target excavation surface computing section 42. If determining in Step 215 that the penetration into the target excavation surface 60 is present, then the target action determination section 49 determines that a cause for the penetration is a forward tilt posture of the machine body, and the process goes to Step 205.

In Step 205, the target action determination section 49 determines whether the operation input is performed on the arm 9 or the bucket 10. If the target action determination section 49 determines in Step 205 that the operation input is performed on the arm 9 or the bucket 10, the process goes to Step 206.

In Step 206, similarly to Step 103 of FIG. 7, the target action determination section 49 determines whether the boom raising command is issued. If determining in Step 206 that the boom raising command is issued, the target action determination section 49 determines not to execute the boom raising control (that is, cancels the boom raising command in Step 206) since the machine body tilt angle θ is great, and issues a command to the informing device 53 to inform the operator that the boom raising control is not executed in Step 212.

If the target action determination section 49 determines that the penetration was present in Step 200, if the target action determination section 49 determines that the penetration into the target excavation surface 60 is not present in Step 202 or 215, or if the target action determination section 49 determines that the machine body tilt angle θ is equal to or less than a predetermined angle θ1 in Step 204, the process goes to Step 207. It is noted that cases of going to Step 207 include a case in which the penetration is not due to the travel, the swing, or the forward tilt posture but for some reason during the excavation work (for example, the deteriorated control accuracy during excavation).

The target action determination section 49 selects the normal boom raising control (first mode) in Step 213 if determining that the arm 9 or the bucket 10 is operated and the boom raising command is issued at that time in Steps 207 and 208. In addition, it is assumed that the target action determination section 49 does not execute the boom raising control in Step 211 if determining that the arm or bucket operation is not present in Step 203, 205, or 207 or if the boom raising command is not output in Step 206 or 208.

Effects of the present embodiment will be described. A case in which the tip end of the work implement 1A moves below the target excavation surface 60 due to the travel of the lower travel structure 11 or the swing of the upper swing structure 12 does not necessarily indicate that the bucket tip end penetrates into the target excavation surface 60 during the excavation work. In the present embodiment, therefore, the boom raising control is executed in the second mode lower in speed than the first mode in such a case, and the operator is informed that the control different from normal control is functioning. By doing so, if the boom raising action at the low speed occurs after the travel or the swing, it is possible to cause the operator to easily recognize that movement of the bucket tip end below the target excavation surface 60 is due to the travel or the swing. Therefore, if the operator does not desire to execute the region limiting control (boom raising control), the operator can easily and spontaneously suspend the region limiting control by the region limiting control switch 17.

Furthermore, if the bucket tip end penetrates into the target excavation surface 60 due to the bad geographical features and the tilting of the machine body, then the excavator has an unstable posture in many cases, and there is a concern of the deteriorated excavation accuracy under such circumstances. In the present embodiment, therefore, even with the penetration into the target excavation surface 60 without the action direction to the lower travel structure 11 or the upper swing structure 12, the target action determination section 49 is configured to regard the tilting of the machine body as the cause for the penetration and to suspend the boom raising control (region limiting control) if the machine body tilt angle θ is greater than the predetermined angle θ1 in the forward tilting direction. With this configuration, it is possible to avoid execution of the boom raising control with the excavator in the unstable posture and continue stable work.

Furthermore, in the present embodiment, the target action determination section 49 is configured to execute Step 207 if a determination result is NO in Steps 201 and 204; thus, even if the bucket tip end penetrates into the target excavation surface 60 for the cause other than the above causes (the travel, the swing, and the tilting of the machine body), the target action determination section 49 can control the boom speed in the first mode. With this configuration, if the bucket tip end penetrates into the region below the target excavation surface 60 for some cause (for example, the deteriorated control accuracy over the bucket tip end) during the excavation work, the bucket tip end can be promptly moved back to the target excavation surface 60; thus, it is possible to prevent deterioration of work efficiency for the excavation work.

Therefore, according to the present embodiment, it is possible to carry out appropriate boom raising control, depending on the various circumstances described above.

Third Embodiment

A third embodiment of the present invention will next be described. The present embodiment is a modification of the first embodiment. It is noted that a hardware configuration of a hydraulic excavator in the present embodiment is the same as that in the first embodiment and, therefore, not described and that functions overlapping those in the first and second embodiments are not described.

Figure 10:
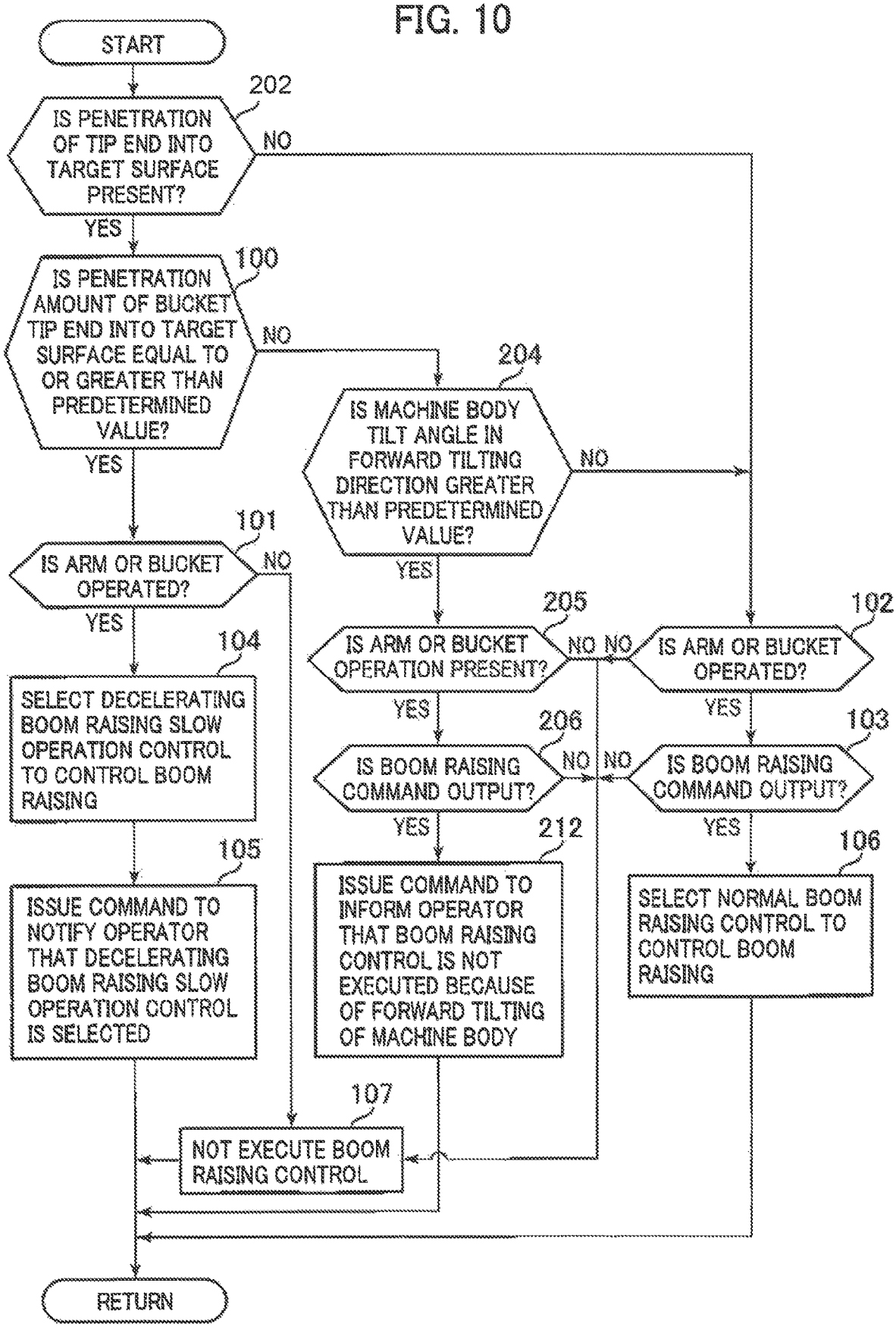
FIG. 10 is a control flowchart according to a third embodiment of the present invention.

FIG. 10 is a flowchart by the target action determination section 49 in the third embodiment. As obvious from this figure, the target action determination section 49 makes determination on the basis of the machine body tilt angle θ of the excavator in Step 204. In addition, the target action determination section 49 (1) selects the second mode if the penetration amount D is equal to or higher than the predetermined value D1 (if the process passes through Step 104), (2) suspends the region limiting control if the penetration amount D is lower than the predetermined value D1 and the machine body tilt angle θ is equal to or greater than the predetermined angle θ1 (if the process passes through Step 212), and (3) selects the first mode if the penetration amount D is lower than the predetermined value D1 and the machine body tilt angle θ is less than the predetermined angle θ1 (if the process passes through Step 105).

In the present embodiment configured as described so far, similarly to the second embodiment, it is possible to avoid execution of the boom raising control with the excavator in the unstable posture and continue stable work.

<Note>

Examples of the first mode and the second mode that are the control modes over the boom raising speed during the execution of the region limiting control will be described with reference to FIGS. 11 and 12.

Figure 11:
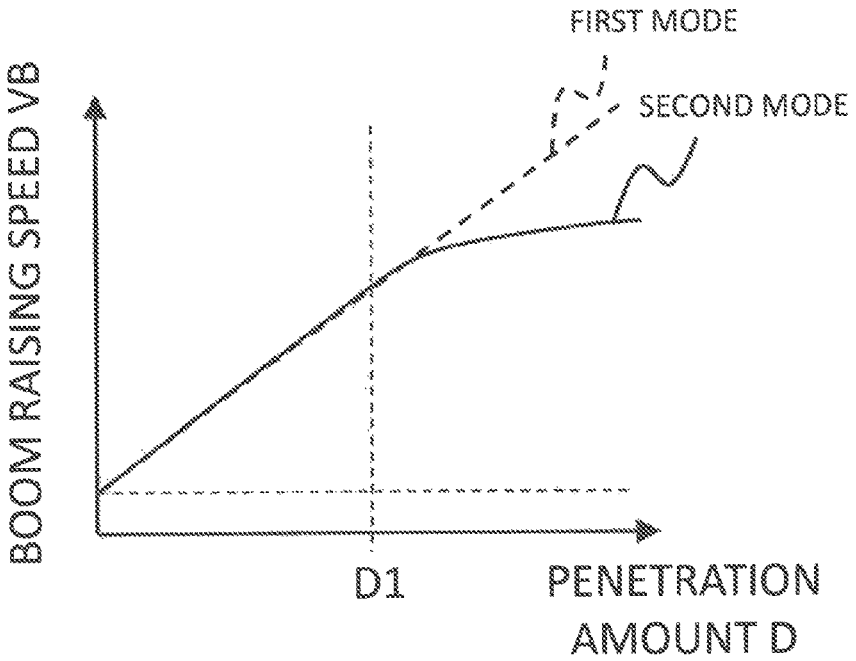
FIG. 11 is a diagram of an example of control modes over a boom raising speed.

In FIG. 11, a boom raising speed VB in the first mode is specified by a straight line and a speed VB in the second mode is specified by a curve. If the first mode and the second mode are smoothly connected at the predetermined value D1 and the penetration amount D changes from a state of being equal to or higher than D1 to a state of being lower than D1, a case of changing over between the modes before and after the predetermined value D1 is supposed. It is noted that the first mode may be similarly specified by a curve or the second mode may be similarly specified by a straight line.

Figure 12:
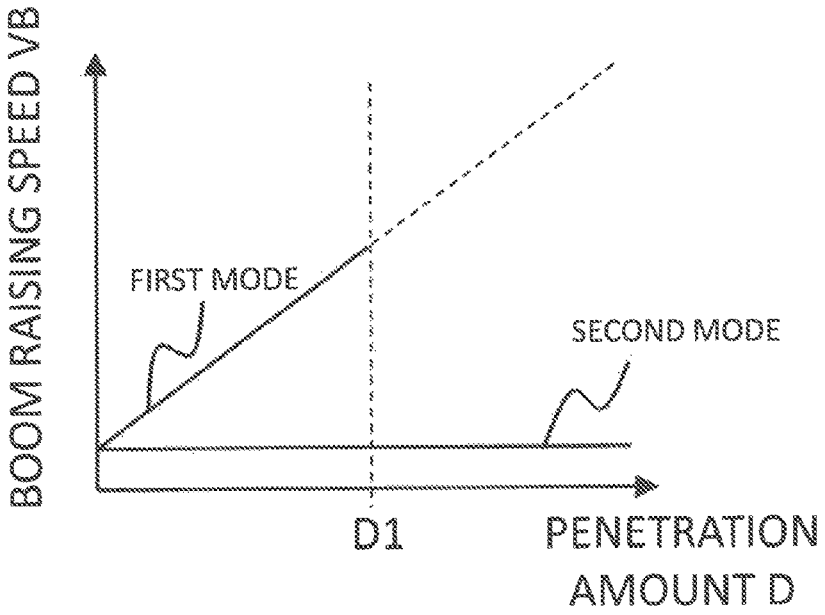
FIG. 12 is a diagram of another example of control modes over the boom raising speed.

In FIG. 12, the speed VB in the second mode is specified by a constant value irrespective of the penetration amount D. In FIG. 12, if the penetration amount D changes from the state of being equal to or higher than D1 to the state of being lower than D1, a case of keeping the second mode until the penetration amount D becomes zero without changeover of the mode even with the penetration amount D reaching the predetermined value D1 (a case of continuously executing the boom speed control based on the second mode until the bucket tip end is located above the target excavation surface 60) is supposed.

While the penetration amount D is associated with the boom raising speed VB for the brevity of description in the examples of FIGS. 11 and 12, the boom raising speed VB in each mode can be made independent of the penetration amount. Any pattern of the first mode and the second mode is applicable to cases other than the examples of FIGS. 11 and 12 as long as the speed in the second mode takes on a value equal to or lower than the speed in the first mode with the same penetration amount.

Meanwhile, while the penetration of the work implement 1A into the target excavation surface 60 has been described while taking the penetration amount of the bucket tip end by way of example in each of the embodiments described above, an object to be controlled is not limited to the bucket tip end. For example, not the bucket tip end but an arbitrary point on the bucket such as the back surface of the bucket may be set as the object to be controlled.

While the angle sensors are used for detecting the angles of the boom, the arm, and the bucket for information about the posture, stroke sensors detecting stroke lengths of the boom cylinder, the arm cylinder, and the bucket cylinder may be used to calculate the information about the posture of the excavator as an alternative to the angle sensors.

In the flowcharts of FIGS. 7, 9, and 10, Steps 101, 102, 103, 203, 205, 206, 207, and 208 can be omitted.

While various types of control is exercised by setting the bucket tip end and the target excavation surface to a two-dimensional coordinate system (excavator coordinate system) set to the hydraulic excavator, the bucket tip end and the target excavation surface may be set to a three-dimensional coordinate system (world coordinate system) set to the ground (Earth) as an alternative to the two-dimensional coordinate system.

In the first embodiment, if a determination result is YES in Step 101, then the same determination (determination whether the boom raising command is output) as that in Step 103 may be additionally executed, and the process may go to Step 104 if a determination result is YES in the additional step and go to Step 107 if the determination result is NO in the additional step.

In the second embodiment, if a determination result is NO in Step 201 (travel operation/swing operation is not present), the process may go not to Step 204 but to Step 207. In other words, Steps 204, 205, 206, and 212 can be omitted.

While it is determined whether the travel or swing operation is present in Step 201, determination may be made only on the basis of the presence of the travel operation. Furthermore, if the bucket tip end is to penetrate into the target excavation surface by the swing on the assumption that the machine control is executed with objects to be controlled including the swing, the swing may be controlled or interrupted.

Moreover, while a determination condition of Step 204 is that the machine body tilt angle θ is equal to or greater than the predetermined angle θ1 in the forward tilting direction, the determination condition is not necessarily limited to the forward tilting direction. For example, the determination condition according to a backward tilting direction or a roll tilting (roll angle) may be used.

Various patterns are available for determination of the penetration into the target excavation surface due to the travel or the swing. For example, as an alternative to the above example, the target action determination section 49 may be configured to monitor the position relationship between the bucket tip end and the target surface during the travel operation or swing operation, and to execute the process of Step 203 upon confirmation of the movement of the bucket tip end from above the target excavation surface to below the target excavation surface.

While the case of suspending the boom raising control if the machine body tilt angle θ exceeds θ1 has been described in the second and third embodiments, the system may be configured such that the boom raising control is exercised in the second mode as an alternative to this case.

DESCRIPTION OF REFERENCE CHARACTERS

1A: Front work implement
8: Boom
9: Arm
10: Bucket
11: Lower travel structure
12: Upper swing structure
30: Boom angle sensor
31: Arm angle sensor
32: Bucket angle sensor
40: Controller
41: Work implement posture computing section
42: Target excavation surface computing section
43: Target action computing section
44: Solenoid proportional valve control section
45: Operation device (boom, arm)
46: Operation device (bucket, swing)
47: Operation device (travel)
49: Target action determination section
53: Informing device
54, 55, 56: Solenoid proportional valve

The invention claimed is:

1. A hydraulic excavator comprising:

a travel structure;

a swing structure swingably attached onto the travel structure;

a multijoint work implement that is attached to the swing structure and that includes a boom, an arm, and a bucket;

an operation lever that outputs an action direction to each of the travel structure, the swing structure, the boom, the arm, and the bucket in response to an operator's operation; and a controller receiving the output action direction from the operation lever and having a processor coupled to a memory storing instructions that when executed by the processor configure the controller to execute region limiting control to forcibly raise the boom in such a manner that a position of a tip end of the work implement is kept on a target excavation surface and within a region above the target excavation surface when the operation lever issues the action direction to the arm or the bucket, wherein the controller is configured to:

select a first mode and a second mode as a control mode of a raising speed of the boom at a time of executing the region limiting control, a boom raising speed during the second mode is set lower than a boom raising speed during the first mode, select the first mode when the tip end of the work implement is located below the target excavation surface and when an amount of the tip end of the work implement that penetrates below the target excavation surface is lower than a predetermined value, and select the second mode when the tip end of the work implement is located below the target excavation surface and when the amount of the tip end of the work implement that penetrates below the target excavation surface is equal to or higher than the predetermined value.

2. The hydraulic excavator according to claim 1, wherein the controller is further configured to:

select the second mode when the amount of the tip end of the work implement that penetrates below the target excavation surface is equal to or higher than the predetermined value, suspend the region limiting control when the amount of the tip end of the work implement that penetrates below the target excavation surface is lower than the predetermined value and a machine body tilt angle of the hydraulic excavator is equal to or greater than a predetermined angle, and select the first mode when the amount of the tip end of the work implement that penetrates below the target excavation surface is lower than the predetermined value and the machine body tilt angle is less than the predetermined angle.

3. The hydraulic excavator according to claim 1, further comprising a monitor that informs an operator of selection of the second mode when the second mode is selected.

4. A hydraulic excavator comprising:

a travel structure;

a swing structure swingably attached onto the travel structure;

a multijoint work implement that is attached to the swing structure and that includes a boom, an arm, and a bucket;

an operation lever that outputs an action direction to each of the travel structure, the swing structure, the boom, the arm, and the bucket in response to an operator's operation; and a controller receiving the output action direction from the operation lever and having a processor coupled to a memory storing instructions that when executed by the processor configure the controller to execute region limiting control to forcibly raise the boom in such a manner that a position of a tip end of the work implement is kept on a target excavation surface and within a region above the target excavation surface when the operation lever issues the action direction to the arm or the bucket, wherein the controller is configured to:

select a first mode and a second mode as a control mode of a raising speed of the boom at a time of executing the region limiting control, a boom raising speed during the second mode is set lower than a boom raising speed during the first mode, select the second mode and control the raising speed of the boom during the region limiting control based on the second mode, regardless of an amount of the tip end of the work implement that penetrates below the target excavation surface, when the tip end of the work implement moves from above to below the target excavation surface by the output action direction to the travel structure or the swing structure from the operation lever, and, select the first mode and control the raising speed of the boom during the region limiting control based on the first mode when the action direction to the travel structure or the swing structure from the operation lever is not present and when the tip end of the work implement moves below the target excavation surface.

* * * * *